US007922511B1

(12) United States Patent
Schweitzer et al.

(10) Patent No.: US 7,922,511 B1
(45) Date of Patent: Apr. 12, 2011

(54) ROTATIONALLY ADJUSTABLE ELECTRICAL CONNECTOR ASSEMBLY

(75) Inventors: Troy Wesley Schweitzer, Fort Wayne, IN (US); John Richard Taller, Huntertown, IN (US)

(73) Assignee: Excellon Technologies, Inc., Fort Wayne, IN (US)

( * ) Notice: Subject to any disclaimer, the term of this patent is extended or adjusted under 35 U.S.C. 154(b) by 0 days.

(21) Appl. No.: 12/586,559

(22) Filed: Sep. 24, 2009

(51) Int. Cl.
*H01R 13/62* (2006.01)
*H01R 13/213* (2006.01)

(52) U.S. Cl. ..... 439/314; 439/171; 439/446

(58) Field of Classification Search ..... 439/314, 439/813, 580, 20, 332, 371, 320, 446, 680, 439/171, 681, 954
See application file for complete search history.

(56) References Cited

U.S. PATENT DOCUMENTS

| | | | | |
|---|---|---|---|---|
| 2,737,543 | A | | 3/1956 | Irwin et al. |
| 3,546,658 | A | | 12/1970 | Van Horssen et al. |
| 3,659,251 | A | | 4/1972 | Fish |
| 3,732,527 | A | | 5/1973 | McKnight |
| 4,018,979 | A | | 4/1977 | Young |
| 4,525,017 | A | | 6/1985 | Schildkraut et al. |
| RE31,995 | E | | 10/1985 | Ball |
| 4,639,064 | A | | 1/1987 | Knapp et al. |
| 4,671,598 | A | | 6/1987 | Keehne |
| 4,863,396 | A | | 9/1989 | Johnson |
| 4,984,995 | A | * | 1/1991 | Tucker et al. ..... 439/321 |
| 5,082,454 | A | | 1/1992 | Tonkiss et al. |
| 5,141,448 | A | * | 8/1992 | Mattingly et al. ..... 439/314 |
| 5,211,576 | A | | 5/1993 | Tonkiss et al. |
| 5,435,760 | A | | 7/1995 | Miklos |
| 5,616,887 | A | | 4/1997 | Kirma |
| 6,419,519 | B1 | | 7/2002 | Young |
| 6,478,619 | B1 | | 11/2002 | Wiechmann |
| 7,201,603 | B1 | | 4/2007 | Finona |
| 7,303,436 | B1 | | 12/2007 | Li |
| 7,333,391 | B2 | | 2/2008 | Chamberlain |

OTHER PUBLICATIONS

Glenair, Inc., "Introduction to Military Standard Cylindrical Connectors", pp. A-2 thru A-8 (2004).

* cited by examiner

*Primary Examiner* — Hae Moon Hyeon
(74) *Attorney, Agent, or Firm* — George Pappas

(57) ABSTRACT

An electrical connector assembly that includes an adjustment collar and a body having an interior volume. The collar defines a passage that is in communication with the interior volume of the body when the collar is engaged with the body. The collar can be rotated relative to the body and can also be fixed to the body with a locking member. The adjustment collar has a helical thread that engages an electrical connector. Wiring extending through the body can be conductively engaged with the electrical connector. The engagement between the collar and the body allows the rotational position of the electrical connector relative to the body to be easily adjusted and then fixed in place by rotation and the subsequent fixation of the adjustment collar. A cooperating electrical connector can be detachably engaged with the electrical connector. A coupling member can be used to secure the cooperating electrical connector.

19 Claims, 2 Drawing Sheets

ROTATIONALLY ADJUSTABLE ELECTRICAL CONNECTOR ASSEMBLY

BACKGROUND OF THE INVENTION

1. Field of the Invention

The present invention relates to electrical connectors and, more particularly, to a housing assembly for an electrical connector.

2. Description of the Related Art

Electrical connectors are used in a wide variety of different applications. The use of standardized electrical connectors provides an easy and convenient method for establishing an electrical connection between two separate elements of an electrical circuit. The use of such electrical connectors is well known in the art. Known electrical connectors can, however, present difficulties in the manufacturing process. In some applications, one of the two mateable electrical connectors must be mounted at a desired orientation to facilitate the mating of the cooperating electrical connector therewith. For example, many military vehicles have a communication system that utilizes a first electrical connector that is mounted within the vehicle with the first connector positioned at a particular orientation. A communication device having a second electrical connector can be deployed with the vehicle by detachably connecting the second electrical connector with the first electrical connector.

When installing the first electrical connector in such an application, the mounting of the first electrical connector at the desired orientation presents a difficult manufacturing task. Typically such a connector is connected to a group of wires that extend through a rigid conduit and into a hollow rigid body on which the connector is secured. The connector is typically screwed into the fixedly mounted body by the engagement of helical threads on both the hollow rigid body and the connector.

This presents two main difficulties. First, there is generally a limit on the amount of "twist" that can be exerted on the wires in communication with the connector during threaded installation of the connector on the rigid body. Second, it is unlikely that the helical threads on the connector and rigid body will "bottom out" and tightly secure the connector at the desired rotational orientation. To overcome these difficulties, the wires may need to be "pre-twisted" in the opposite direction relative to the twisting that the wires experience during installation of the electrical connector prior to joining the wires to the connector. The connector will also generally have to be fixed relative to the rigid body by coating the threaded connection between the connector and rigid body with an adhesive to secure the connector to the rigid body in the desired rotational orientation. These steps complicate the installation of the electrical connector and increase the amount of labor required for the installation. Moreover, once the electrical connector has been installed, if the electrical connector is subsequently rotated relative to the rigid body, e.g., by the end user attempting to adjust the rotational position of the electrical connector or disassemble the device for maintenance, the adhesive bond between the threads on the electrical connector and the rigid body will be broken. Once the adhesive bond is broken, the electrical connector will no longer be fixed in a particular rotational position and vibrations may cause the rotational position of the electrical connector to shift over time.

SUMMARY OF THE INVENTION

The present invention provides an improved electrical connector assembly that allows the rotational position of an electrical connector to be easily adjusted and subsequently fixed in place during installation of the electrical connector.

The invention comprises, in one form thereof, an electrical connector assembly operable to provide conductive communication between at least one wire and a cooperating connector. The assembly includes a body defining an interior volume wherein the interior volume is in communication with a first opening and a second opening. An adjustment collar defining a passage having a first end and a second end is engageable with the body proximate the first opening in an unsecured condition and in a secured condition. The first end of the adjustment collar passage is in communication with the interior volume of the body when the adjustment collar is engaged with the body in both the unsecured condition and the secured condition. The adjustment collar is rotatable relative to the body in the unsecured condition and is rotatably fixed relative to the body when in the secured condition. The adjustment collar defines a helical thread proximate the second end of the passage. The assembly also includes a connecting member having at least one conductive element wherein the connecting member defines a mateable interface and a wire-connecting interface. The mateable interface is engageable with the cooperating connector and the wire-connecting interface is engageable with the at least one wire. The conductive element extends between the mateable interface and the wire-connecting interface whereby electrical current is communicable from the at least one wire to the cooperating connector through the at least one conductive element. The connecting member defines a second helical thread wherein the connecting member is fixable relative to the adjustment collar by secure engagement of the first and second helical threads. When the first and second helical threads are engaged and the adjustment collar is engaged with the body, the at least one wire is extendable through the interior volume of the body from the wire-connecting interface to the second opening of the body. The cooperating connector is also detachably engageable with the connecting member when the first and second helical threads are engaged and the adjustment collar is engaged with the body.

The invention comprises, in another form thereof, an electrical connector assembly operable to provide conductive communication between a plurality of wires and a cooperating connector. The assembly includes a body and an adjustment collar. The body defines an interior volume wherein the interior volume is in communication with a first opening and a second opening. The adjustment collar defines a passage having a first end and a second end. One of the body and the adjustable collar defines a substantially cylindrical bore and the other of the body and the adjustable collar defines a substantially cylindrical exterior surface whereby the exterior surface is positionable within the cylindrical bore to thereby engage the adjustment collar with the body proximate the first opening in both an unsecured condition and a secured condition. The first end of the passage is in communication with the interior volume in both the unsecured condition and in the secured condition. The adjustment collar is rotatable relative to the body when in the unsecured condition and is rotatably fixed relative to the body when in the secured condition. The adjustment collar defines a first helical thread proximate the second end of the passage. The assembly includes at least one locking member that is engageable with each of the adjustable collar and the body. Engagement of the locking member with the adjustable collar and the body secures the adjustable collar in the secured condition. A connecting member having a plurality of conductive elements defines both a mateable interface and a wire-connecting interface. The mateable interface is engageable with the cooperating connector and the wire-connecting interface is engageable with the plurality of wires. Each of the plurality of conductive elements extends between the mateable interface and the wire-connecting interface whereby electrical current is communicable from each of the plurality of wires to the cooperating connector through a respective one of the plurality of conductive elements. The connecting member defines a second helical thread wherein the connecting member can be fixed relative to the adjustment collar by secure engagement of the first and second helical threads. When the first and second helical threads are engaged and the adjustment collar is engaged with the body, the plurality of wires is extendable through the interior volume of the body from the wire-connecting interface to the second opening of the body. The cooperating connector is also detachably engageable with the connecting member when the first and second helical threads are engaged and the adjustment collar is engaged with the body.

In some embodiments, a coupling member that is engageable with the cooperating connector to selectively secure the cooperating connector with the connecting member is provided. By providing the adjustment collar with a first radially outwardly projecting flange and the connecting member with a second radially outwardly projecting flange, such a coupling member can be rotatably captured between the first and second flanges.

The invention comprises, in still another form thereof, an electrical connector assembly operable to provide conductive communication between at least one wire and a cooperating connector. The assembly includes a body defining an interior volume that is in communication with a first opening and a second opening. An adjustment collar defining a passage having a first end and a second end is engageable with the body proximate the first opening. The adjustment collar is engageable with the body with the first end of the passage being in communication with the interior volume in both an unsecured condition and a secured condition. The adjustment collar is rotatable relative to the body in the unsecured condition. The adjustment collar is rotatably fixed relative to the body when in the secured condition. The adjustment collar has a first helical thread proximate the second end of the passage. At least one locking member is engageable with each of the adjustable collar and the body. Engagement of the locking member with the adjustable collar and the body secures the adjustable collar in the secured condition. The assembly also includes a connecting member having at least one conductive element. The connecting member defines a mateable interface and a wire-connecting interface. The mateable interface is engageable with the cooperating connector and the wire-connecting interface is engageable with the at least one wire. The conductive element extends between the mateable interface and the wire-connecting interface whereby electrical current is communicable from the at least one wire to the cooperating connector through the at least one conductive element. The connecting member includes a second helical thread wherein the connecting member is fixable relative to the adjustment collar by secure engagement of the first and second helical threads. When the first and second helical threads are engaged and the adjustment collar is engaged with the body, the cooperating connector is detachably engageable with the connecting member and the at least one wire is extendable through the interior volume from the wire-connecting interface to the second opening of the body. A coupling member is operably coupled with the electrical connector assembly and is engageable with the cooperating connector to selectively secure the cooperating connector with the connecting member.

BRIEF DESCRIPTION OF THE DRAWINGS

The above mentioned and other features of this invention, and the manner of attaining them, will become more apparent and the invention itself will be better understood by reference to the following description of an embodiment of the invention taken in conjunction with the accompanying drawings, wherein.

Figure 2:
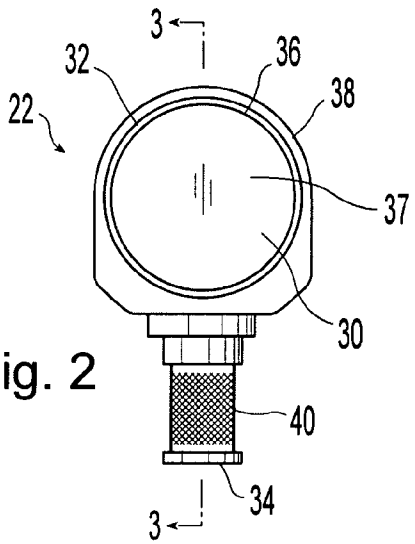
FIG. 2 is a top view of the housing body of the connector assembly of FIG. 1.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DETAILED DESCRIPTION OF THE INVENTION

Figure 1:
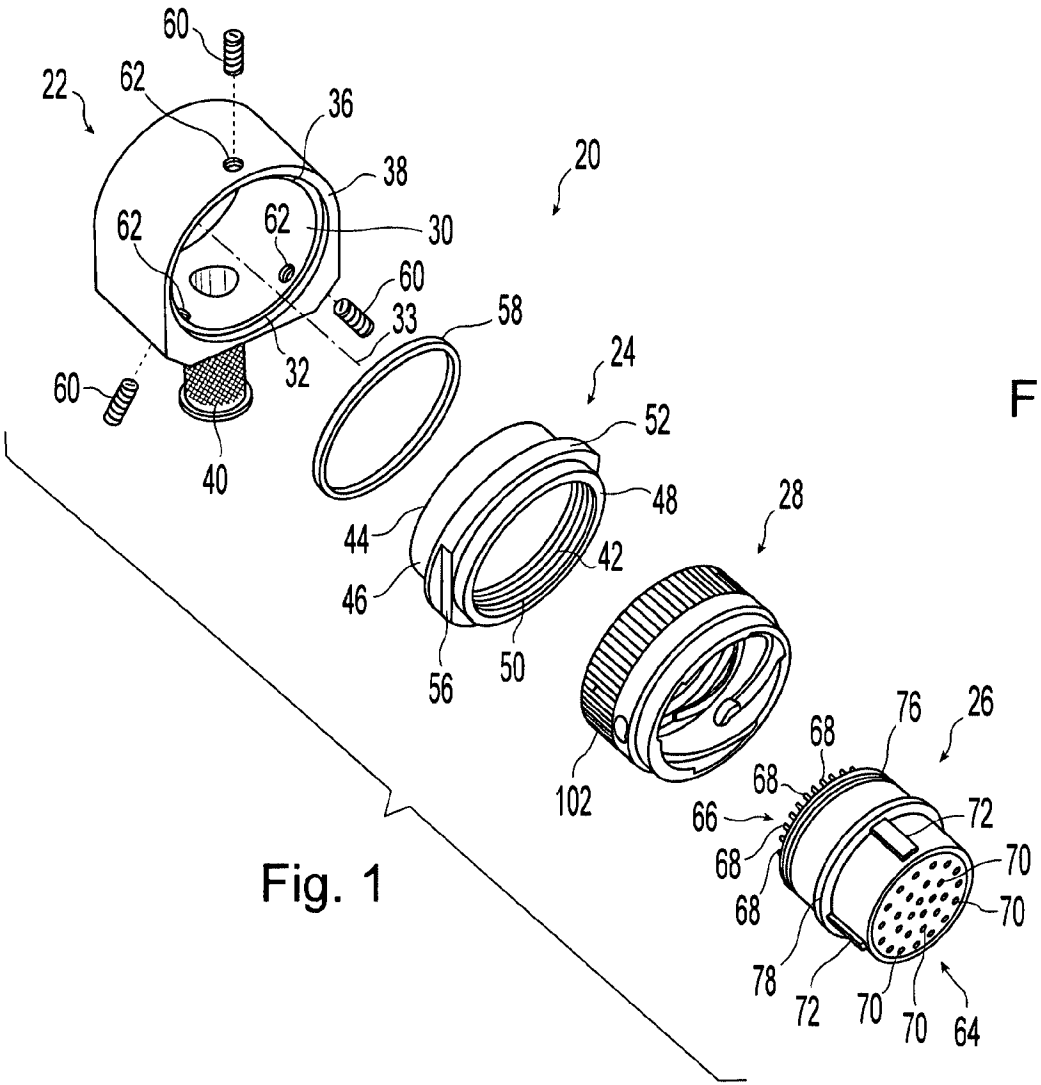
FIG. 1 is an exploded view of an electrical connector assembly.

An electrical connector assembly 20 in accordance with the present invention is illustrated in an exploded view in FIG. 1. Assembly 20 includes a body 22, an adjustment collar 24, a connecting member 26 and a coupling member 28.

A brief description of how assembly 20 allows for the relatively easy rotational adjustment of connecting member 26 relative to body 22 will be followed by a more detailed description of assembly 20 and its operation. Connecting member 26 may take the form of a conventional electrical connector. When installing connecting member 26 on body 22, connecting member 26 is first secured to adjustment collar 24 with coupling member 28 rotatably captured between radial flanges 52 and 78 located on collar 24 and connecting member 26 respectively. A braided wire cable 75 is routed through body 22 and the individual wires 74 forming cable 75 are then engaged with the individual conductive elements 68 of connecting member 26. Conductive elements 68 are accessible through the central passage 42 of collar 24. Once wires 74 and conductive elements 68 have been conductively engaged, substantially cylindrical surface 46 on collar 24 is positioned within cylindrical bore 37 formed in body 22. Because surface 46 and bore 37 are both substantially cylindrical but not threaded, relative rotational movement between collar 24 and body 22 is permitted but is not required to secure collar 24 to body 22. After engaging collar 24 with body 22, collar 24 is rotated to orient connecting member 26 in a desired rotational orientation. Locking members 60 are then used to secure adjustment collar 24 to body 22 and thereby fix the rotational position of connecting member 26.

Figure 3:
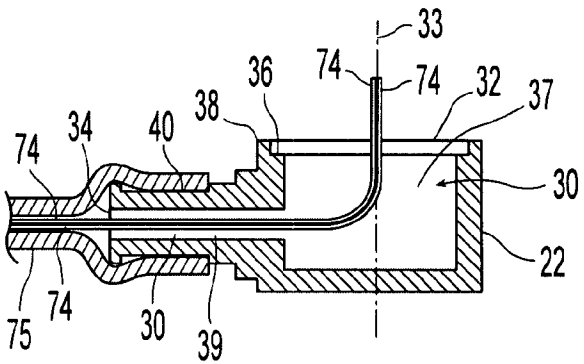
FIG. 3 is a cross sectional view taken along line 3-3 of FIG. 2.

The individual parts forming assembly 20 and their functionality will now be discussed in greater detail. Body 22 is shown in FIGS. 2 and 3 and forms a housing on which connecting member 26 is mounted. Body 22 defines an interior volume 30 that forms a passageway between a first opening 32 and a second opening 34. Interior volume 30 defines a first opening 32 and a cylindrical bore 37. In the illustrated embodiment, interior volume 30 is formed by cylindrical bore 37 and a wire passage 39 extending through lateral extension 40.

As further discussed below, adjustment collar 24 is inserted through opening 32 and is at least partially positioned within cylindrical bore 37. A radially inwardly projecting surface 36 is located within interior volume 30 proximate opening 32 and forms an annular ledge on which O-ring seal 58 is seated. A radially outwardly projecting surface 38 on the exterior of body 22 circumscribes opening 32.

The opposite end of interior volume 30 formed by wire passage 39 extends through a lateral extension or adapter 40 and terminates at second opening 34. The EMI ("electromagnetic interference") sheathing of cable 75 is extended over the outside surface of lateral extension 40 and secured thereto with a clamping device in a manner well known in the art. Lateral extension 40 is thus configured to be joined with a conventional EMI shielded cable 75 whereby wiring 74 within cable 75 can be extended through opening 34 and interior volume 30 for engagement with a connecting member 26 installed at opening 32. The depiction of cable 75 in FIG. 3 is schematic in nature and has been simplified showing only two wires 74 for purposes of graphical clarity. Various other configurations of body 22 and second opening 34 may also be employed to adapt assembly 20 for use in alternative applications.

Adjustment collar 24 is securable to connecting member 26 and engageable with body 22. Adjustment collar 24 provides for the rotational adjustment of connecting member 26 relative to body 22. Collar 24 has a passage 42 that extends through collar 24 from a first end 44 to an opposite second end 48. First end 44 has an exterior surface that forms a substantially cylindrical surface 46 and can be rotatably positioned within cylindrical bore 37. The opposite second end 48 has an exterior surface that defines a helical thread 50. Connecting member 26 threadingly engages helical thread 50 and is thereby secured to adjustment collar 24.

While in the illustrated embodiment, it is the collar 24 that includes an exterior cylindrical surface that is positioned within a cylindrical bore formed in body 22, alternative embodiments of the present invention could reverse this arrangement and utilize a body having an exterior cylindrical surface that is positioned within a cylindrical bore formed in the adjustment collar. The configuration of the rotational engagement between the body and adjustment collar can also be modified in yet other alternative embodiments.

Located between the two opposing ends 44, 48 of adjustment collar 24 is a radially outwardly projecting flange 52. Flange 52 defines an annular surface 54 that faces body 22 when the first end 44 of collar 24 is positioned within bore hole 37. Flange 52 also defines two radially outwardly facing substantially planar surfaces or flats 56. Flats 56 are positioned diametrically opposite one another and allow collar 24 to be easily grasped by a wrench or other similar tool when it is necessary to control the rotational movement of collar 24. In the illustrated embodiment, flats 56 do not extend for the full axial length of flange 52 so that flats 56 will not reduce the area of annular surface 54.

When the first end 44 of collar 24 is positioned within bore 37 an O-ring seal 58 encircles substantially cylindrical surface 46 and is positioned adjacent annular surface 54 and annular ledge 36. O-ring 58 is compressed between annular surface 54 and surface 36 to form a seal between collar 24 and body 22 at this location and inhibit the ingress of particulates and moisture into interior volume 30. Various other arrangements for sealing this joint between collar 24 and body 22 can also be employed with the present invention.

When first end 44 of collar 24 is first positioned within bore 37 to engage collar 24 with body 22, the substantially cylindrical surface 46 of first end 44 will be rotatable within the cylindrical bore 37. In this unsecured condition, the rotational position of collar 24 relative to body 22 can be adjusted. Because cylindrical surface 46 and bore 37 are not helically threaded surfaces, the axial position of collar 24 relative to body 22, i.e., the position of collar 24 along bore axis 33, does not change as the rotational position of collar 24 is adjusted.

After positioning collar 24 in the desired rotational orientation it is secured to body 22 to prevent further relative rotational movement between collar 24 and body 22. In other words, adjustment collar 24 is engageable with body 22 with the first end 44 of passage 42 being in communication with interior volume 30 through first opening 32 in body 22 in both an unsecured condition wherein relative rotation of collar 24 and body 22 is allowed and a secured condition wherein collar 24 is fixed relative to body 22.

In the illustrated embodiment, collar 24 is secured relative to body 22 by engaging each of the collar 24 and body 22 with at least one locking member 60. In the illustrated embodiment, three locking members 60 in the form of threaded set screws are provided. Body 22 defines three threaded bores 62 that receive set screws 60. When collar 24 is positioned within bore 37 at the desired rotational position, set screws 60 are advanced radially inwardly within threaded bores 62 until their distal ends firmly engage collar 24 and thereby secure collar 24 in a fixed position relative to body 22.

Figure 5A:
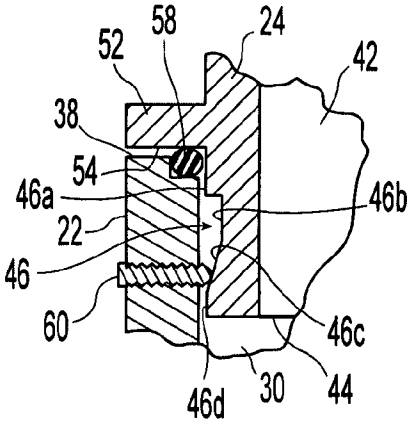
FIG. 5A is an enlarged cross sectional view of a portion of the adjustment collar engaged with the housing body.
Figure 5:
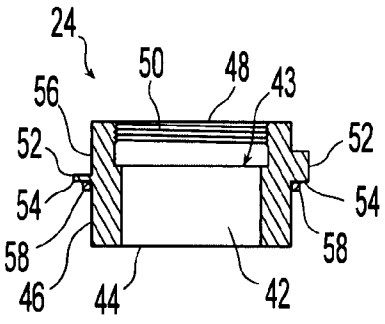
FIG. 5 is a cross sectional view taken along line 5-5 of FIG. 4.

FIG. 5A provides an enlarged view illustrating the securement of collar 24 relative to body 22 with set screws 60. As can be seen in FIG. 5, exterior substantially cylindrical surface 46 located on collar 24 is not a perfect cylindrical surface but includes several distinct outward facing surfaces 46*a*, 46*b*, 46*c* and 46*d* while still retaining a substantially cylindrical surface. Surface 46*a* is a cylindrical surface located adjacent flange 52 and has a diameter that is sufficient to maintain O-ring 58 between surfaces 54 and 36. Surface 46*b* is also cylindrical but has a diameter that is less than the diameter of surface 46*a*. Surface 46*d* is located adjacent first end 44 and is a cylindrical surface having a diameter that is larger than that of surface 46*b*. Surface 46*c* is an angle surface extending between surfaces 46*b* and 46*d* and defines a variable diameter. When set screw 60 is advanced radially inwardly to engage collar 24 it will contact surface 46*c*. As set screw 60 is advanced against surface 46*c*, the interaction between screw 60 and angled surface 46*c* will pull collar 24 into bore 37 and further compress O-ring 58 providing a secure and sealed connection between collar 24 and body 22.

The configuration of the illustrated collar 24 and body 22 allows collar 24 to be secured at any rotational position within the full 360 degrees of rotation about axis 33. If it was found desirable for a particular application, alternative embodiments could, however, provide a more limited range of rotational adjustment. For example the shape of bore 37 and exterior surface 46 could be altered to limit the range of rotational movement.

The threaded nature of the engagement between set screws 60 and body 22 inhibits the ingress of particulates and moisture through threaded bores 62 into interior volume 30. It would also be possible, however, to use a separate sealing member to seal bores 62. For example, locking members 60 could include radially enlarged fastener heads that trap an O-ring seal between the fastener head and the exterior surface of body 22. Alternative embodiments of the present invention may also use various other forms of locking members to secure adjustment collar 24 relative to body 22. It is further noted that the illustrated body 22 and adjustment collar 24 are each machined aluminum parts. Other suitable materials and manufacturing methods, however, can also be used to form body 22 and adjustment collar 24

In the illustrated embodiment, connecting member 26 is a conventional electrical connector having a standardized configuration and a construction well-known to those having ordinary skill in the art. Connecting member 26 includes a mateable interface 64 and a wire-engaging interface 66. Conductive elements 68 extend between the two interfaces 64, 66 and communicate electrical current therebetween.

The mateable interface 64 takes the form of a "socket" interface with a plurality of ports 70 which receive projecting conductive elements 82 of a cooperating electrical connector 80 which takes the form of a "plug" interface. When conductive elements 82 are inserted into respective ports 70, the elements 82 are conductively engaged with conductive elements 68. Ridges 72 are asymmetrically located along the exterior of connecting member 26 and engage grooves on cooperating electrical connector 80 to ensure that connector 80 is properly aligned with member 26 when engaging the two electrical connectors together.

Each of the conductive elements 68 extend from the rear of connecting member 26 to enable their conductive engagement with a conductive wire 74. A plurality of conductive wires 74 are extended through opening 34 and interior volume 30 to reach the projecting ends of conductive elements 68 that form the wire-engaging interface 66 when installing connector assembly 20. Each of the conductive elements 68 is conductively engaged with an individual wire 74 by soldering, crimping or other suitable method. When cooperating electrical connector 80 is subsequently engaged with connecting member 26, electrical current can be communicated from each the wires 74 through a respective one of the conductive elements 68 to individual conductive elements 82 on the cooperating connector 80 which are, in turn, in communication with a corresponding plurality of wires or other conductive elements to thereby transmit electrical current, e.g., electrical signals and/or electrical power, between the two electrical connectors 26, 80.

A radially outwardly projecting flange 78 is located between opposing interfaces 64, 66 on connecting member 26. When securing connecting member 26 to adjustment collar 24, coupling member 28 is first positioned between connecting member 26 and collar 24 so that coupling member 28 will be rotatably captured between flange 52 and flange 78. In other words, coupling member 28 can rotate relative to connecting member 26 and collar 24 but cannot be removed from between connecting member 26 and collar 24 without disengaging connecting member 26 and collar 24.

A helical thread 76 is provided on connecting member 26 to secure member 26 to collar 24. Helical thread 76 is engageable with the helical thread 50 located on adjustment collar 24 proximate second end 48 of passage 42. When securing connecting member 26 to collar 24, threads 50, 76 can be relatively rotated until the threads "bottom out" and connecting member 26 is firmly secured to adjustment collar 24. Preferably, collar 24 includes an annular stop surface 43 and the interface 66 of connecting member 26 abuts stop surface 43 when securing connecting member 26 to collar 24 and thereby causing connecting member 26 to "bottom out" and precisely affix the axial position of connecting member 26 relative to collar 24. An adhesive may optionally be used to further secure threads 50, 76 together. Because adjustment collar 24 can rotate relative to body 22, the precise rotational position of connecting member 26 relative to collar 24 does not determine the final rotational orientation of connecting member 26 relative to body 22. This simplifies the attachment of connector 26 by allowing connector 26 to be threaded into engagement with collar 24 until the threads "bottom out" without concern about the relative rotational positions of connector 26 and collar 24.

As mentioned above, coupling member 28 is rotatably captured between flanges 52, 78 by the attachment of connecting member 26 to adjustment collar 24. Coupling member 28 forms a generally tubular sleeve with a central passage 90. An annular groove 92 is located within passage 90 and has a spring or wavy washer 94 mounted therein. Spring washer 94 projects radially inwardly into passage 90. Flange 52 on adjustment collar 24 has a diameter larger than passage 90. When positioning coupling member 28 between adjustment collar 24 and connecting member 26, flange 52 on adjustment collar 24 will abut the axial end 91 of coupling member 28 without entering passage 90. Flange 78 on connecting member 26, however, can enter passage 90 through axial end 93 and will abuttingly engage spring washer 94. Thus, the axial movement of coupling member 28 is limited in one axial direction by its abutment with flange 52 on collar 24 and the axial movement of coupling member 28 is limited in the opposite axial direction by the abutment of spring washer 94 with flange 78. The axial distance between flanges 52 and 78 is sufficient to allow coupling member 28 to be manually rotated about axis 33. When coupling member 28 is engaged with cooperating electrical connector 80 as discussed below, spring washer 94 will be compressed between flange 78 and an opposing surface of groove 92. Spring washer 94 will thereby exert a biasing force that axially urges cooperating electrical connector 80 into engagement with connecting member 26 through coupling member 28.

Figure 8:
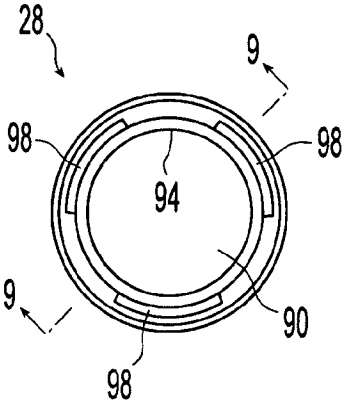
FIG. 8 is a top view of the coupling member.
Figure 9:
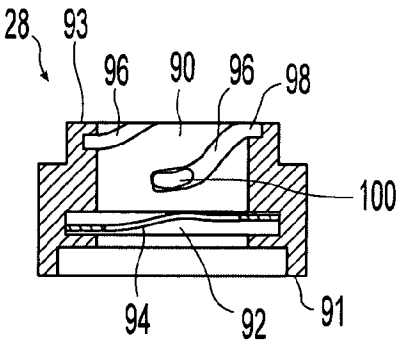
FIG. 9 is a cross sectional view taken along line 9-9 of FIG. 8.
Figure 6:
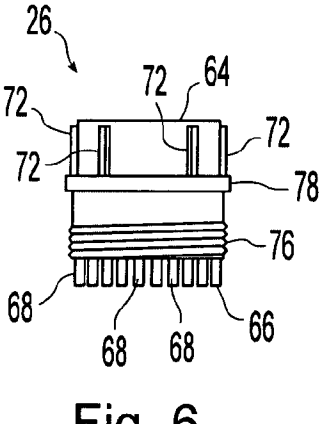
FIG. 6 is a side view of the connecting member of the connector assembly of FIG. 1.
Figure 7:
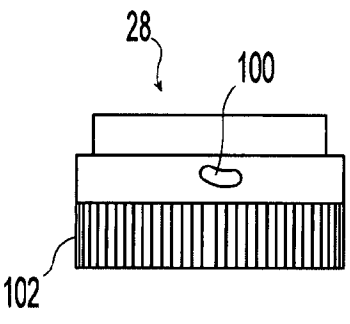
FIG. 7 is a side view of the coupling member of the connector assembly of FIG. 1.
Figure 4:
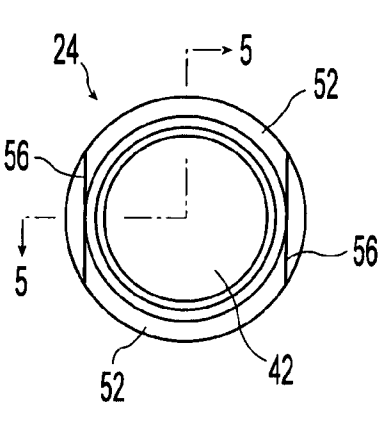
FIG. 4 is a top view of the adjustment collar of the connector assembly of FIG. 1.

As best seen in FIGS. 1, 8 and 9, coupling member 28 includes three inclined grooves 96 for engaging mounting lugs 84 on cooperating electrical connector 80. Grooves 96 intersect one axial end of coupling member 28 to form entry ports 98 for lugs 84. Side ports 100 extend through the side wall of coupling member 28 and are located at the end of grooves 96 opposite entry ports 98. Lugs 84 are seated within side ports 100 when cooperating electrical connector 80 is fully engaged with connecting member 26. When engaging the cooperating electrical connector 80 with connecting member 26, lugs 84 are axially inserted into grooves 96 through entry ports 98 and conductive projections 82 are each axially inserted into a respective one of the ports 70. Coupling member 28 is then manually rotated and the interaction of grooves 96 with lugs 84 pulls the cooperating electrical connector 80 into firm engagement with connecting member 26. Ridges 102 located on the exterior of coupling member 28 facilitate the manual rotation of coupling member 28. Coupling member 28 is thereby engageable with the cooperating electrical connector 80 to selectively and mechanically secure the cooperating electrical connector 80 with connecting member 26.

Figure 10:
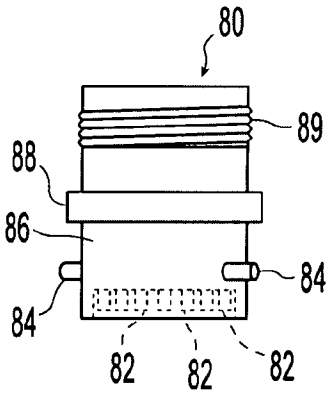
FIG. 10 is a view of a cooperating electrical connector mateable with the electrical connector assembly of FIG. 1.

Cooperating member 80 is depicted in FIG. 10 and includes a generally tubular sleeve 86 from which lugs 84 project outwardly. Conductive projections 82 are located in a recessed area at one end of electrical connector 80. Mateable interface 64 of connecting member 26 is insertable into this recessed area to allow projections 82 to be inserted into ports 70. Projections 82 and ports 70 are arranged in a common configuration so that each of the projections 82 will correspond to the location of one of the ports 70. In this regard, it is noted that there are standard configurations for electrical connectors and both of the illustrated electrical connectors 26, 80 have a conventional configuration and construction well known to those having ordinary skill in the art. Similarly, coupling member 28 also has a standard configuration and operates in a manner well known to those having ordinary skill in the art.

While projections 82 and ports 70 will most often correspond to a standard configuration, custom configurations of the projections 82 and ports 70 can also be employed with the present invention. It is also noted that the radial inner surface of sleeve 86 within the recessed area includes axially extending grooves (not shown) that correspond to the asymmetrical ridges 72 on connecting member 26. The location of these ridges and grooves is another aspect of the connectors 26, 80 that will typically correspond to a pre-defined standard.

A radial flange 88 projects outwardly from sleeve 86 and together with helical thread 89 facilitates the engagement of cooperating electrical connector 80 with an electrical conduit or other structure. The ends of conductive elements 82 proximate thread 89 are conductively joined to wiring or other conductive members (not shown) by soldering, crimping or other suitable method.

While this invention has been described as having an exemplary design, the present invention may be further modified within the spirit and scope of this disclosure. This application is therefore intended to cover any variations, uses, or adaptations of the invention using its general principles.

What is claimed is:

1. An electrical connector assembly operable to provide conductive communication between at least one wire and a cooperating connector, said assembly comprising:

a body defining an interior volume, said interior volume being in communication with a first opening and a second opening;

an adjustment collar defining a passage having a first end and a second end, said adjustment collar being engageable with said body proximate said first opening in an unsecured condition and in a secured condition with said first end of said passage being in communication with said interior volume, said adjustment collar being rotatable relative to said body in said unsecured condition and being rotatably fixed relative to said body when in said secured condition, and wherein said adjustment collar defines a first helical thread proximate said second end of said passage;

a connecting member having at least one conductive element wherein said connecting member defines a mateable interface and a wire-connecting interface, said mateable interface being engageable with the cooperating connector and said wire-connecting interface being engageable with the at least one wire, said conductive element extending between said mateable interface and said wire-connecting interface whereby electrical current is communicable from the at least one wire to the cooperating connector through said at least one conductive element; said connecting member defining a second helical thread wherein said connecting member is fixable relative to said adjustment collar by secure engagement of said first and second helical threads and wherein, when said first and second helical threads are engaged and said adjustment collar is engaged with said body, the cooperating connector is detachably engageable with said connecting member and the at least one wire is extendable through said interior volume from said wire-connecting interface to said second opening of said body; and, wherein said body defines a substantially cylindrical bore proximate said first opening and said first end of adjustable collar defines a substantially cylindrical exterior surface rotatably positionable within said cylindrical bore.

2. The assembly of claim 1 wherein said body second opening extends laterally relative to said body first opening.

3. An electrical connector assembly operable to provide conductive communication between at least one wire and a cooperating connector, said assembly comprising:

a body defining an interior volume, said interior volume being in communication with a first opening and a second opening;

an adjustment collar defining a passage having a first end and a second end, said adjustment collar being engageable with said body proximate said first opening in an unsecured condition and in a secured condition with said first end of said passage being in communication with said interior volume, said adjustment collar being rotatable relative to said body in said unsecured condition and being rotatably fixed relative to said body when in said secured condition, and wherein said adjustment collar defines a first helical thread proximate said second end of said passage;

a connecting member having at least one conductive element wherein said connecting member defines a mateable interface and a wire-connecting interface, said mateable interface being engageable with the cooperating connector and said wire-connecting interface being engageable with the at least one wire, said conductive element extending between said mateable interface and said wire-connecting interface whereby electrical current is communicable from the at least one wire to the cooperating connector through said at least one conductive element; said connecting member defining a second helical thread wherein said connecting member is fixable relative to said adjustment collar by secure engagement of said first and second helical threads and wherein, when said first and second helical threads are engaged and said adjustment collar is engaged with said body, the cooperating connector is detachably engageable with said connecting member and the at least one wire is extendable through said interior volume from said wire-connecting interface to said second opening of said body;

wherein at least one of said body and said adjustable collar defines a substantially cylindrical bore and the other of said body and said adjustable collar defines a substantially cylindrical exterior surface whereby said exterior surface is positionable within said cylindrical bore to thereby engage said adjustment collar with said body; and, further comprising an O-ring seal disposed between said adjustment collar and said body when said adjustment collar is engaged with said body.

4. The assembly of claim 3 wherein said body second opening extends laterally relative to said body first opening.

5. An electrical connector assembly operable to provide conductive communication between at least one wire and a cooperating connector, said assembly comprising:

a body defining an interior volume, said interior volume being in communication with a first opening and a second opening;

an adjustment collar defining a passage having a first end and a second end, said adjustment collar being engageable with said body proximate said first opening in an unsecured condition and in a secured condition with said first end of said passage being in communication with said interior volume, said adjustment collar being rotatable relative to said body in said unsecured condition and being rotatably fixed relative to said body when in said secured condition, and wherein said adjustment collar defines a first helical thread proximate said second end of said passage;

a connecting member having at least one conductive element wherein said connecting member defines a mateable interface and a wire-connecting interface, said mateable interface being engageable with the cooperating connector and said wire-connecting interface being engageable with the at least one wire, said conductive element extending between said mateable interface and said wire-connecting interface whereby electrical current is communicable from the at least one wire to the cooperating connector through said at least one conductive element; said connecting member defining a second helical thread wherein said connecting member is fixable relative to said adjustment collar by secure engagement of said first and second helical threads and wherein, when said first and second helical threads are engaged and said adjustment collar is engaged with said body, the cooperating connector is detachably engageable with said connecting member and the at least one wire is extendable through said interior volume from said wire-connecting interface to said second opening of said body; and, further comprising a coupling member, said coupling member being engageable with said cooperating connector to selectively secure said cooperating connector with said connecting member.

6. The assembly of claim 5 wherein said coupling member is rotatably captured between a first radially outwardly projecting flange on said adjustment collar and a second radially outwardly projecting flange on said connecting member.

7. The assembly of claim 5 wherein said body second opening extends laterally relative to said body first opening.

8. An electrical connector assembly operable to provide conductive communication between a plurality of wires and a cooperating connector, said assembly comprising:

a body defining an interior volume, said interior volume being in communication with a first opening and a second opening;

an adjustment collar defining a passage having a first end and a second end, wherein one of said body and said adjustable collar defines a substantially cylindrical bore and the other of said body and said adjustable collar defines a substantially cylindrical exterior surface whereby said exterior surface is positionable within said cylindrical bore to thereby engage said adjustment collar with said body proximate said first opening in both an unsecured condition and a secured condition with said first end of said passage being in communication with said interior volume, said adjustment collar being rotatable relative to said body in said unsecured condition and being rotatably fixed relative to said body when in said secured condition, and wherein said adjustment collar defines a first helical thread proximate said second end of said passage;

at least one locking member engageable with each of said adjustable collar and said body and wherein engagement of said locking member with said adjustable collar and said body secures said adjustable collar in said secured condition;

a connecting member having a plurality of conductive elements wherein said connecting member defines a mateable interface and a wire-connecting interface, said mateable interface being engageable with the cooperating connector and said wire-connecting interface being engageable with the plurality of wires, each of said plurality of conductive elements extending between said mateable interface and said wire-connecting interface whereby electrical current is communicable from each of the plurality of wires to the cooperating connector through a respective one of said plurality of conductive elements; said connecting member defining a second helical thread wherein said connecting member is fixable relative to said adjustment collar by secure engagement of said first and second helical threads and wherein, when said first and second helical threads are engaged and said adjustment collar is engaged with said body, the cooperating connector is detachably engageable with said connecting member and the plurality of wires is extendable through said interior volume from said wire-connecting interface to said second opening of said body; and, further comprising an O-ring seal disposed between said adjustment collar and said body when said adjustment collar is engaged with said body.

9. The assembly of claim 8 wherein said body defines said cylindrical bore and said adjustment collar defines said exterior surface.

10. The assembly of claim 9 further comprising a coupling member, said coupling member being engageable with said cooperating connector to selectively secure said cooperating connector with said connecting member.

11. The assembly of claim 10 wherein said coupling member is rotatably captured between a first radially outwardly projecting flange on said adjustment collar and a second radially outwardly projecting flange on said connecting member and wherein said O-ring seal encircles said substantially cylindrical exterior surface and is positioned adjacent said first flange.

12. The assembly of claim 11 wherein said first flange includes at least two radially outwardly facing substantially planar surfaces engageable with a tool.

13. The assembly of claim 9 wherein said adjustment collar includes a first radially outwardly projecting flange and said O-ring seal is sealingly engaged between said body and said first flange when said cylindrical exterior surface is positioned within said cylindrical opening.

14. The assembly of claim 13 wherein said connecting member includes a second radially outwardly projecting flange and said assembly further comprises a coupling member, said coupling member being engageable with the cooperating connector to selectively secure the cooperating connector with said connecting member, said coupling member being rotatably captured between said first radially outwardly projecting flange and said second radially outwardly projecting flange when said connecting member is threadingly engaged with said adjustment collar.

15. The assembly of claim 8 wherein said body second opening extends laterally relative to said body first opening.

16. An electrical connector assembly operable to provide conductive communication between at least one wire and a cooperating connector, said assembly comprising:

a body defining an interior volume, said interior volume being in communication with a first opening and a second opening;

an adjustment collar defining a passage having a first end and a second end, said adjustment collar being engageable with said body proximate said first opening in an unsecured condition and in a secured condition with said first end of said passage being in communication with said interior volume, said adjustment collar being rotatable relative to said body in said unsecured condition and being rotatably fixed relative to said body when in said secured condition, and wherein said adjustment collar defines a first helical thread proximate said second end of said passage;

at least one locking member engageable with each of said adjustable collar and said body and wherein engagement of said locking member with said adjustable collar and said body secures said adjustable collar in said secured condition;

a connecting member having at least one conductive element wherein said connecting member defines a mateable interface and a wire-connecting interface, said mateable interface being engageable with the cooperating connector and said wire-connecting interface being engageable with the at least one wire, said conductive element extending between said mateable interface and said wire-connecting interface whereby electrical current is communicable from the at least one wire to the cooperating connector through said at least one conductive element; said connecting member defining a second helical thread wherein said connecting member is fixable relative to said adjustment collar by secure engagement of said first and second helical threads and wherein, when said first and second helical threads are engaged and said adjustment collar is engaged with said body, the cooperating connector is detachably engageable with said connecting member and the at least one wire is extendable through said interior volume from said wire-connecting interface to said second opening of said body; and a coupling member operably coupled with the electrical connector assembly, said coupling member being engageable with said cooperating connector to selectively secure said cooperating connector with said connecting member.

17. The assembly of claim 16 wherein said coupling member is rotatably captured between a first radially outwardly projecting flange on said adjustment collar and a second radially outwardly projecting flange on said connecting member.

18. The assembly of claim 16 wherein at least one of said body and said adjustable collar defines a substantially cylindrical bore and the other of said body and said adjustable collar defines a substantially cylindrical exterior surface whereby said exterior surface is positionable within said cylindrical bore to thereby engage said adjustment collar with said body.

19. The assembly of claim 16 wherein said body second opening extends laterally relative to said body first opening.

* * * * *